US008375663B2

(12) United States Patent
Johnston et al.

(10) Patent No.: US 8,375,663 B2
(45) Date of Patent: Feb. 19, 2013

(54) INTEGRAL WALL BASE AND FLASH COVE

(75) Inventors: Curt Johnston, Auburn, OH (US); Mark J. Sauter, Palatine, IL (US)

(73) Assignee: Johnsonite Inc., Chagrin Falls, OH (US)

( * ) Notice: Subject to any disclaimer, the term of this patent is extended or adjusted under 35 U.S.C. 154(b) by 0 days.

(21) Appl. No.: 12/998,433

(22) PCT Filed: Oct. 8, 2009

(86) PCT No.: PCT/US2009/005524

§ 371 (c)(1),
(2), (4) Date: Apr. 20, 2011

(87) PCT Pub. No.: WO2010/047744

PCT Pub. Date: Apr. 29, 2010

(65) Prior Publication Data

US 2011/0192101 A1 Aug. 11, 2011

Related U.S. Application Data

(60) Provisional application No. 61/196,749, filed on Oct. 20, 2008.

(51) Int. Cl.
*E04B 2/00* (2006.01)
*B32B 3/30* (2006.01)

(52) U.S. Cl. ..... 52/287.1; 52/717.03

(58) Field of Classification Search ..... 52/287.1, 52/288.1, 717.03, 275; 428/81, 130, 167, 428/172, 192

See application file for complete search history.

(56) References Cited

U.S. PATENT DOCUMENTS

| | | | | |
|---|---|---|---|---|
| 1,663,774 | A | 3/1928 | Petersen | |
| 2,069,289 | A | 2/1937 | Swedensen et al. | |
| 2,111,922 | A | 3/1938 | Borkenstein | |
| 2,307,338 | A | 1/1943 | Sluyter et al. | |
| 2,651,086 | A | 9/1953 | Corson | |
| 2,994,905 | A | 8/1961 | Franker, Jr. | |
| 3,092,869 | A | 6/1963 | Stump | |
| 3,192,576 | A | 7/1965 | Wieting | |
| 4,478,017 | A | 10/1984 | Brown et al. | |
| 5,010,703 | A | 4/1991 | Pearlman et al. | |
| D380,280 | S | 6/1997 | Ingraham | |
| D424,709 | S | 5/2000 | Minidis | |
| 6,401,418 | B1 | 6/2002 | Senn et al. | |
| 6,537,189 | B1 * | 3/2003 | Gehle | 493/396 |
| 7,914,878 | B2 * | 3/2011 | Carnes et al. | 428/167 |
| 2005/0055936 | A1 | 3/2005 | Murphy, Jr. et al. | |
| 2009/0092790 | A1 * | 4/2009 | Carnes et al. | 428/156 |
| 2011/0221092 | A1 * | 9/2011 | Carnes et al. | 264/177.17 |

* cited by examiner

*Primary Examiner* — Mark Wendell
(74) *Attorney, Agent, or Firm* — D. Peter Hochberg; Sean F. Mellino; Daniel J. Smola

(57) ABSTRACT

An integral wall base and flash cove having a wall portion, an elongated toe and a concave cove interconnecting the wall portion and the elongated toe in smooth transition. The integral wall base and flash cove can be wrapped around inside and outside corners without the need for a separate molded corner. The integral wall base and flash cove can be installed without required a cove stick or top cap moulding.

57 Claims, 11 Drawing Sheets

INTEGRAL WALL BASE AND FLASH COVE

This International Application claims priority of U.S. Provisional Application Ser. No. 61/196,749 filed Oct. 20, 2008.

BACKGROUND OF THE INVENTION

1. Field of the Invention

The invention relates to wall bases and flash coves, and is directed in particular to unitary wall bases and flash coves which can be used in sanitary rooms.

2. Description of the Prior Art

Baseboards, baseboard trim or wall bases are known in the art as the molding or trim applied at the base of a wall to act as the transition between wall and the floor. These wall bases decorate as well as protect the wall from scuffing and impact from feet, vacuum cleaners, wheelchairs, dollies, wheeled furniture, etc. Furthermore, the wall bases protect the edge of the carpet or flooring adjacent to the wall, and can cover the edge of the carpet to prevent curling of the carpet edge, give a neater appearance and prevent dirt from going underneath the carpet. Baseboards prevent the accumulation of dirt at the intersection of the wall and the floor—which is usually difficult to clean.

In addition, the wall bases can hide unsightly electrical, telephone or other wires, protecting the wires from damage and preventing people from tripping over these wires or inadvertently touching them, and for preventing young children from playing with the wires.

Wall bases are commonly used where a wall meets a floor to provide a neat and acceptable appearance at the wall-floor juncture. Wall bases are made from a variety of materials, using a variety of methods. These wall bases are preferably all moldings, but wall bases do not have to be moldings—originally they were made out of wood. One commonly used type of molding for wall bases is made from a polymeric material, such as polyvinyl chloride (PVC) that is extruded in one of many well known processes. Extruded PVC molding is typically a cost effective building material that can be provided in an array of colors and styles. Thermoplastic rubber is also a common material for extruded wall bases. Some of these wall bases can be wrapped around inside and outside corners (a corner is the juncture of two transverse walls) of a room. However, there is no cove support in these prior art wall bases which means it can be easily punctured or damaged from an impact. Furthermore, these wall bases lack any type of elongated toe and therefore lack a sufficient surface area to adhere to the floor to take a surface impact.

In the description to follow, the relevant portion of a room is defined as a floor, a floor base or subfloor which meets a wall. The bottom portion or base of a wall is covered with a wall base portion or wall portion. The floor base (which could be concrete or the like) is covered near the wall portion of the wall with a "floor member" or "toe," which could be a tile, particularly a plastic tile such as a PVC tile. The transition in the corner connecting the wall portion and the floor member is a cove. If the cove is integral with the wall portion and the floor member, the integrated unit is referred to as an "integral wall base and flash cove."

Wall bases can also be clean room compatible. A clean room is a room in which contaminants such as dust are reduced to a very low level by special procedures so that operations such as the manufacture and assembly of delicate equipment or the manipulation of biological materials can be performed effectively. Such clean rooms can exist, for example, in a hospital environment, a laboratory environment and certain manufacturing facilities such as for making some electronic components, etc., where it is necessary to prevent any dirt, germs, bacteria, etc. from building up between the floor and the walls. Special floor installation processes are used in areas such as hospital operating rooms or clean rooms. Sheet vinyl must be "flash-coved" up a portion of the wall using heat-welded or chemical-welded seams to create a monolithic seamless homogeneous floor and cove on which a heavy flow of water can be applied to the sheet vinyl for cleaning. Using flash coving, the floor curves into the wall base, to provide a smooth curve between the curved portion, the toe and the wall portion (the curved portion is tangent to both the floor and the wall) and eliminates the difficult- to-clean right angle which would otherwise appear at the standard wall and floor junction. Applying flash coving is a special application that requires much skill and practice from the floorlayer.

Flash coving is well known in the art. Flash coving is also considered to be an extension of the conventional wall base, the latter being perpendicular to the floor and extending partly up the wall. In the conventional flash coving process, the first step is to install a cove stick at the juncture of the wall and floor to support the cove material where it coves up the wall (and coves from the wall base to the floor). If there is no support behind the flash coving material (i.e. if there is cove stick), the cove can be punctured or at least partially collapsed in response to pressure or the force of a sharp object applied thereto. The second step of flash coving is to install a top cap moulding or cap strip which serves as the point where the sheet flooring terminates as it extends up the wall. The third step is cutting and installation of the sheet flooring so it abuts against the coving. The sheet flooring is ordinarily a flexible plastic material such as polyvinyl chloride (PVC). Flash coving at the inside and outside corners (a corner is the juncture of two transverse walls) of a wall requires the use of hand cut pattern inserts known as "butterfly" or "boot" patterns to be cut and carefully fit to the inside or outside corner. These hand cut patterns are necessary to provide the minimum amount of vertical seaming and the best finished appearance. This technique forms smooth transitions at these corners, since the sheet flooring cannot be curved around these corners in one piece. The edges of the sheet flooring have to be cut at an angle so that they form a smooth surface when the pieces of sheet flooring abut each other. The corners are viewed as the most difficult, costly and time-intensive element of any flash coving installation. The work involved with installing flash coving at inside and outside corners of the wall involves costly hand-scribing, wasted time and extra skilled craftsmen skilled at the corner-forming process. Multiple adhesion steps are then done to secure the sheet flooring to the cove stick and the wall. For example, each piece of separate sheeting flooring must be individually glued to the wall and/or the floor, and adjustments in the method are made at each corner to accommodate the numerous variations found in each corner of a room, or an entire building. Thus, eliminating this multiple adhesion process would save time.

Wall bases can also be associated with standard flash coving, where wall bases replace the part of the flooring extending up the wall. In other words, the bottom of the wall portion curves at the base of the wall to the toe. As mentioned above, the wall corner is often viewed as the most difficult, costly and time-intensive portion of any wall base installation involving flash coving. To achieve this type of wall base, a separate molded integral corner piece was needed to make respective outside and inside wall corners as mentioned above, i.e. the wall corner where the respective transverse portions of the wall base would meet. Those skilled in the art will recognize that this type of molding has a variety of drawbacks. First, construction of the wall base is not easy, as separate molded corner pieces are needed to be inserted or cut to make outside and inside wall corners respectively. The separate molded corner pieces must be precisely cut from a single sheet of material with a miter saw or by hand with a utility knife to fit outside or inside corners. Second, only a limited number of wall base design profiles can be achieved by the separate molded corner piece for typical flash coving due to the size of the material and the complexity of the design. These factors limit the mold design and the mold press which is required to manufacture these separate molded corners. A profile is a cross-section of the wall base taken from the top of the wall base to the toe of the wall base. The more complicated the design of the profile, the more difficult it is to make outside and inside corners for the profile. Furthermore and most important, installation of these wall bases is very difficult because of the need to precisely cut the separate molded corner pieces using a miter saw and maintain the continuity of the design. A skilled craftsman is necessary to successfully install a wall base with flash coving. To achieve a clean room or sanitary wall base with this procedure, many seams at the corners of the wall base and the separate molded corner pieces may need to be sealed, either by heat welding or chemical welding. This complicates the installation process and introduces more potential areas where flaws could occur in the seals, thus allowing dirt, germs, bacteria, etc. to build up and remain, hence compromising a clean room environment. There are also variations in material construction that make the seaming method more complex and less reliable. The seaming method must work with the floor material and the flash profile wall base, since the floor material and the wall base often come from two manufacturers using different types of material, and the method may not provide a reliable sanitary seal.

To avoid this skilled labor requirement and consuming installation, flooring manufacturers began producing whole separate molded corner pieces for inside or outside corners. These whole separate molded corner pieces are pre-manufactured by flooring companies and are made ready to install. However, creating these pre-manufactured molded corner pieces simply places the burden of dealing with the complicated corners on the flooring manufacturer rather than the skilled craftsman installing the wall base. Furthermore, these whole separate molded corner pieces still require their seams to be welded.

U.S. Design Pat. No. 424,709 to Minidis discloses an ornamental design for a cove base. Minidis discloses a wall base profile with a curved lower corner. Although not in the claimed design, Minidis shows the supporting structure in hidden lines that would accompany the cove base to install it at the juncture of the wall and floor. Thus, the cove base of Minidis is not self-supported.

U.S. Design Pat. No. 380,280 to Ingraham discloses an ornamental design for a cap. Ingraham shows an angled lower corner.

U.S. Pat. No. 3,092,869 to Stump displays a carpet fastener with contouring surface which is overlaid with carpet, i.e. the carpet fastener supports a carpet at a floor and wall juncture. Stump discloses a gap shown in the floor member part of the fastener for accommodating an insertable plywood tackless carpet strip or fastener. The curved corner section of Stump is very thick compared to the floor member and vertical wall member. Stump has a chamfer or angled portion which allows for clearance between the floor and the wall.

Accordingly, there is a need for a unitary or integral wall base (with a foot member) and flash cove that permits easy manufacture and installation and allows for many variations in design of the unit without the need for a cove stick, and without the labor for installing the cove stick and using the cove stick in the final installation. Desirably, such a unitary wall base and flash cove can be cut with a miter saw to make outside and inside corners without the need for a separate molded corner. Such a system would have fewer seams to weld, and would for example, be compatible in a clean room. The desired unit could reduce the potential number of flaws that could occur at the seams. Most desirably, such a unit would maintain a strong, structurally sound mounting of the molding to the wall and the floor which allows for easy installation. Time saving is particularly important in multiple room facilities where curved wall bases are required such as for apartment buildings, hospitals, hotels, manufacturing facilities, laboratories and the like.

SUMMARY OF THE INVENTION

The present invention provides a solution to the above-described problem of producing and installing a molded plastic integral wall base and flash cove. The invention is particularly directed to providing a continuous or integral wall base and flash cove design which allows the wall base and flash cove to be wrapped around outside wall corners and inside wall corners. Only the bottom portion of the integral wall base and flash cove, namely the floor member or toe, needs to be cut with a miter saw to make the inventive integral wall base and flash cove fit on outside and inside wall corners. Thus, the need for cutting a separate molded corner piece with a miter saw and individually gluing these pieces to the wall corner is eliminated. Similarly, the need for the flooring manufacturer to produce separate molded corner pieces for the wall corner is also dispensed with. The lack of cutting or producing separate molded corner pieces at the wall corner requires fewer seams that need to be welded and allows the integral wall base and flash cove to be clean room compatible. Other advantages of the present invention include reduced time for installing the integral wall base and flash cove on straight wall applications, i.e. where the wall is not interrupted by another transverse wall to form a corner. Since the integral wall base and flash cove design can be bent around corners, the integral wall base and flash cove can be produced in larger sections or lengths. Thus, the present invention can be produced in lengths such as eight feet or greater rather than shorter incremental sections which were previously required due to corners in a room. Hence, when installing the present wall base and cove design in a straight wall application, the wall base can be quickly installed since larger sections are used, which also reduces the number of seams to be welded in a straight wall application.

The integral wall base and flash cove eliminates two installation procedures for a typical flash cove, namely, (1) the installation of the cove stick and (2) the installation of the top cap moulding. Furthermore, the integral wall base and flash cove allows for easier (and more economical) installation and a higher degree of design possibilities, without the need for workmen highly skilled in flash coving techniques. A thicker gauge material at the cove of the integral wall base and flash cove provides greater protection from holes being punctured in the cove due to the lack of a cove stick to provide support. This thicker gauge material results in the cove portion having a stronger transverse strength than the wall portion and the floor member. That is, there is a higher level of strength resisting forces applied to the cove portion in a transverse direction to the cove, then to a similar force applied to the wall portion or the floor member. For example, corners along door jambs will not be easily damaged by buffing machines and machines traversing floors. The integral wall base and flash cove thickness will also mask wall imperfections as do other wall bases. The elongated floor member or toe possible with the present invention allows for easier installation and reduces potential flaws in any seal between the flooring and the integral wall base and flash cove, since the seal is not so close to the cove. The toe of the invention may run up to four inches or longer out on to the floor, which will allow sufficient adhesive coverage and bond to the floor base or floor substrate to reduce a risk of displacement or seal failure when the wall is impacted by carts or buffers. The present invention also provides a flexible design profile, which integral wall base and flash cove can bend when installed to accommodate the angle between the floor and the wall, which is typically between 85 and 95 degrees.

It is an object of the present invention is to provide an integral wall base and flash cove that is self-supported and can be easily installed without a cove stick or top cap moulding.

Another object of the present invention is to provide an integral wall base and flash cove that includes a cove portion having a stronger transverse strength than the wall portion and the floor member.

It is a further object of the present invention to provide an integral wall base and flash cove that can be wrapped around outside and inside corners of a wall without the need for a separate molded corner piece.

Another object of the present invention is to provide an integral wall base and flash cove of greater lengths than are presently available, which can be quickly installed in straight wall applications.

Yet another object of the present invention is to provide an integral wall base and flash cove with fewer seams needed to be welded than present wall base and flash coves, are clean room compatible.

Still another object of the present invention is to provide an integral wall base and flash cove as a single finished unit which can be easily installed.

Another object of the present invention is to eliminate the need for workmen skilled in flash coving techniques for installing the inventive product.

A further object of the present invention is to reduce significant construction time and money associated with flash coving techniques.

Yet another object of the present invention is to reduce the amount of tools necessary for flash coving, which is a significant barrier to the tradesmen.

Still another object of the present invention is to provide an inexpensive and easily cleanable integral wall base and flash cove.

Another object of the present invention is to provide a more easily repairable integral wall base and flash cove if such repairs are necessary.

DETAILED DESCRIPTION OF THE INVENTION

Disclosed according to the preferred embodiment of the present invention are integral wall bases and flash coves and uses thereof. The integral wall base and flash cove eliminates the need for a cove stick required for typical flash coving. The integral wall base and flash cove also eliminates the need to make inside and outside corners. The integral wall base and flash cove can be cut with a miter saw, utility knife, or similar tool, to make outside and inside corners without the need of a separate molded corner piece at all, and without the necessary labor for attaching the latter corner piece to the integral wall base and flash cove as described below. The elimination of the cove stick and the need to precisely cut the outside and inside corners greatly reduces the number of steps and skill required, and ultimately, the installation time. Essentially, the present invention can be easily installed as a finished product and eliminates various steps and procedures of the prior art. One of the benefits of the present invention is that the wall base can be clean room compatible as previously discussed.

Figure 1:
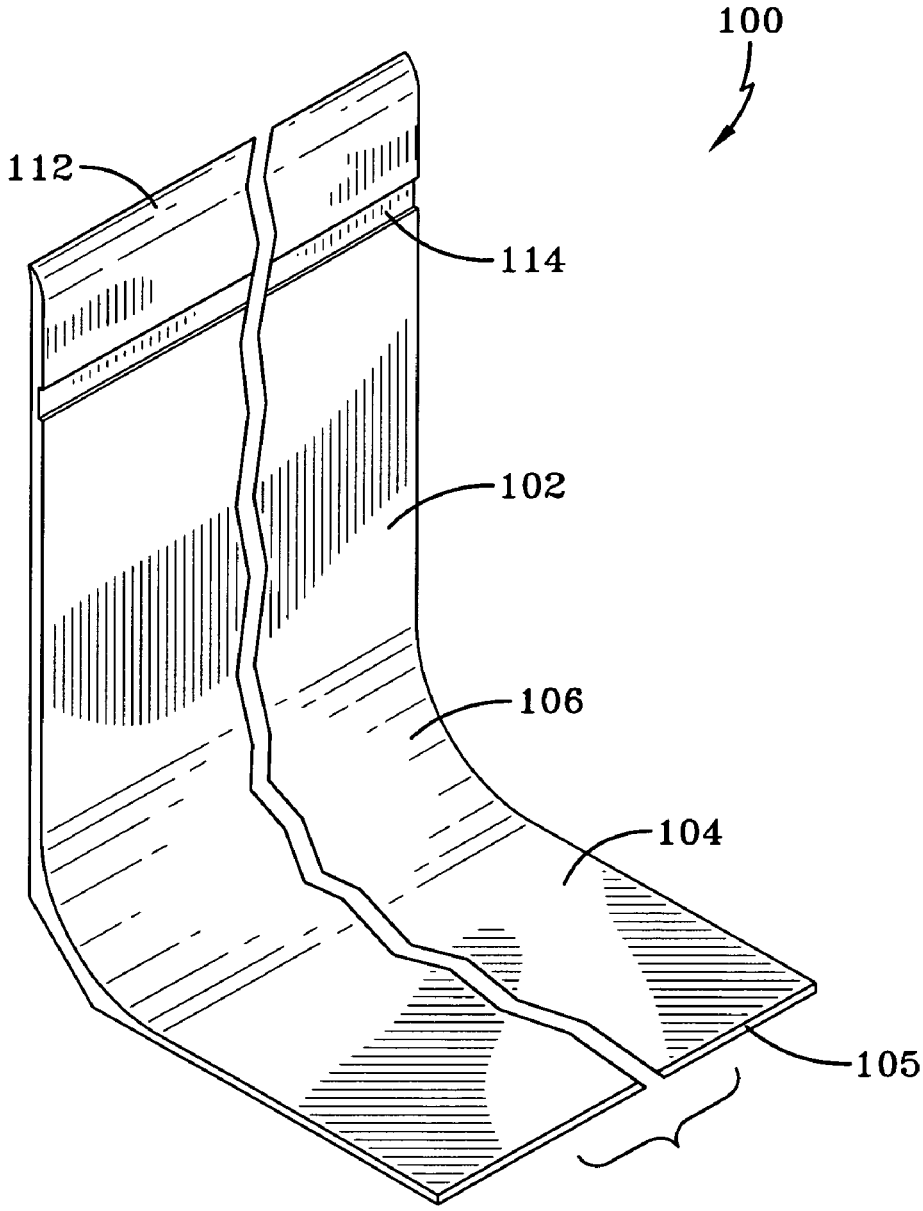
FIG. 1 is a perspective view of an integral wall base and flash cove according to the present invention.

Turning now to FIG. 1, illustrated is an example integral wall base and flash cove 100 according to one embodiment of the present invention. The integral wall base and flash cove is configured to be installed where flooring meets the wall. Integral wall base and flash cove 100 comprises a wall base portion or wall portion 102, a floor member or elongated toe 104 with a toe end 105, and a concave cove 106 which connects wall portion 102 to elongated toe 104. Concave cove 106 is the transition connecting wall portion 102 and elongated toe 104. Wall portion 102 is substantially perpendicular to elongated toe 104. Wall portion 102 is installed to be parallel with a wall surface. Likewise, elongated toe 104 is adjacent and parallel with a floor surface when installed.

Figure 2:
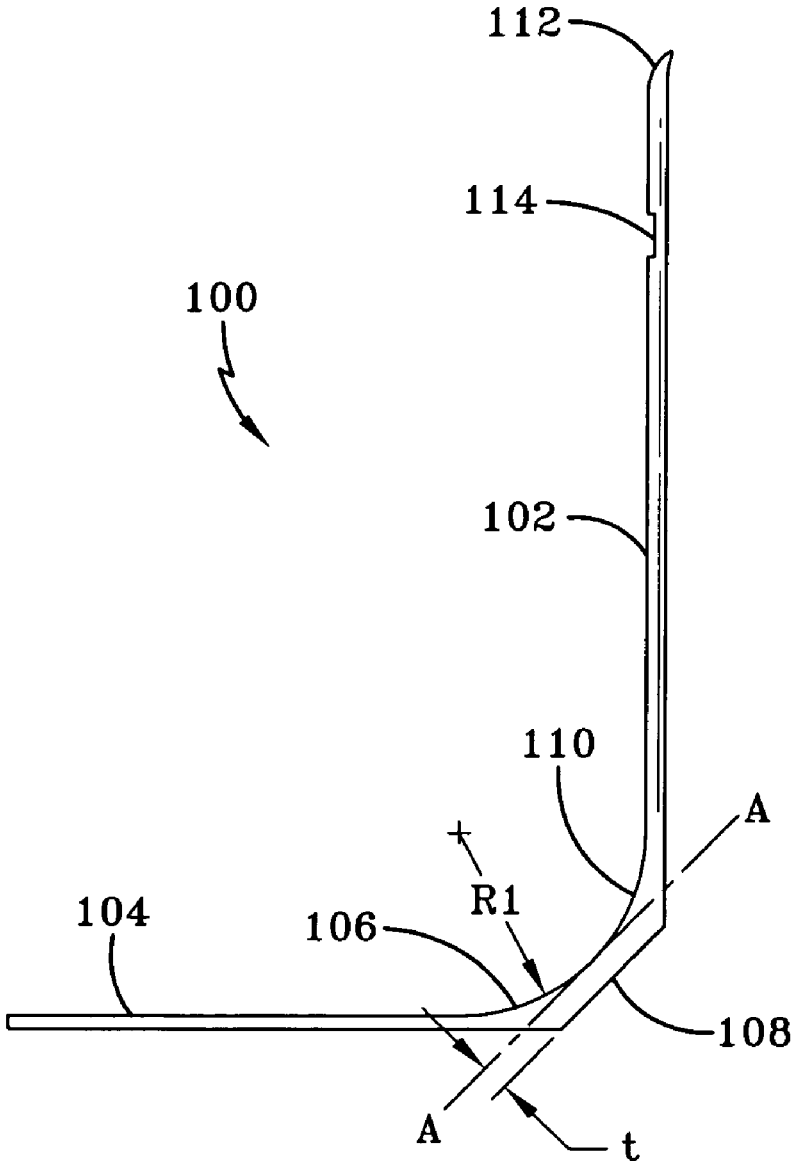
FIG. 2 is a side view or profile of the integral wall base and flash cove shown in FIG. 1.

Turning now to FIG. 2, concave cove 106 comprises an outer cove surface 108 for facing a floor and wall juncture when installed and an inner or exterior cove surface 110 for facing the room or exterior when integral wall base and flash cove 100 is installed. Outer surface 108 is planar and angled, but is preferably angled between about 30 degrees and 60 degrees relative to the floor. Inner surface 110 is curved to provide a continuous and smooth transition between wall portion 102 and elongated toe 104. The curve of inner surface 110 is concave when viewed by an observer facing the corner of the wall and floor, and should be aesthetically attractive and easy to clean. The curve of inner surface 110 is preferably defined by a radius R1. In an alternative embodiment, it is possible that more than one radius can define the curve of inner surface 110. Inner surface 110 can have other shapes that are not defined by a radius or radii.

Wall portion 102 can further include a tip 112. Tip 112 can be rounded to provide a smooth transition between wall base 100 and the wall. Tip 112 curves towards the wall, to prevent dirt and dust from accumulating on top of wall base 100, and to prevent items from falling behind wall base 100, i.e. between wall base 100 and the wall. Wall portion 102 can also have a slot 114 for decorative purposes.

FIG. 2 shows a tangent line A which is tangent to curved inner surface 110 and parallel to outer surface 108 which defines a thickness t for concave cove 106. Thickness t can vary in value and depends on the length of radius R1. Thickness t allows for greater protection from potential holes being poked through the wall base from, for example, buffing machines. Adjusting radius R1 of inner surface 110 while maintaining thickness t for concave cove 106 creates alternate embodiments for the wall base. For example, if the length of R1 is reduced and thickness t remains constant, the length of outer surface 108 will increase. Similarly, if the length of R1 is increased and thickness t remains constant, the length of outer surface 108 will also increase. As previously mentioned, thickness t can vary in value based on the particular dimensions of R1 and outer surface 108, but thickness t should be greater than the thickness of wall portion 102 and floor member 104.

Figure 3:
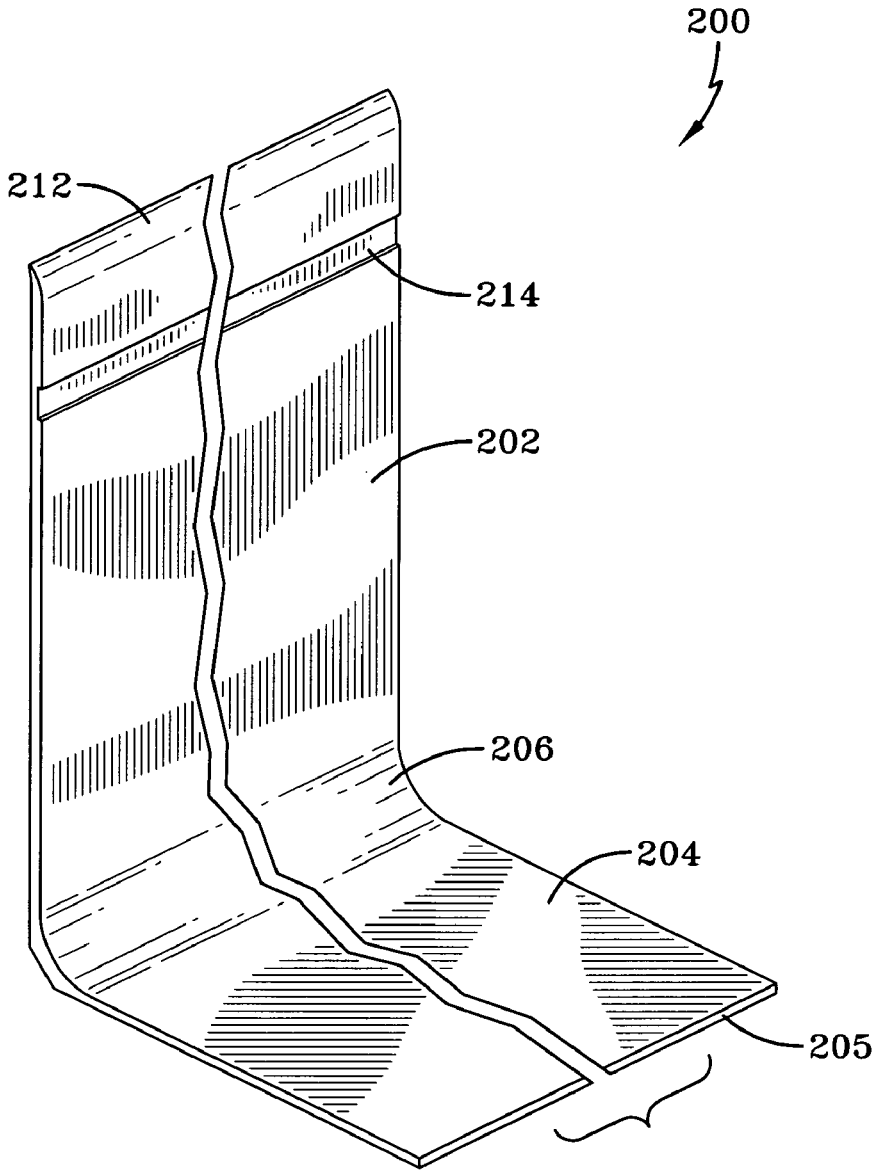
FIG. 3 is a perspective view of a second embodiment of the invention.

FIG. 3 shows an alternate embodiment integral wall base and flash cove 200. As shown in FIG. 3, integral wall base and flash cove 200 comprises a wall portion 202, an elongated toe or floor member 204 with a toe end 205, and a concave cove 206 which connects wall portion 202 to elongated toe 204. Wall portion 202 is substantially perpendicular to elongated toe 204. Wall portion 202 is installed to be parallel to the wall surface. Likewise, elongated toe 204 is parallel with the floor surface when installed.

Figure 4:
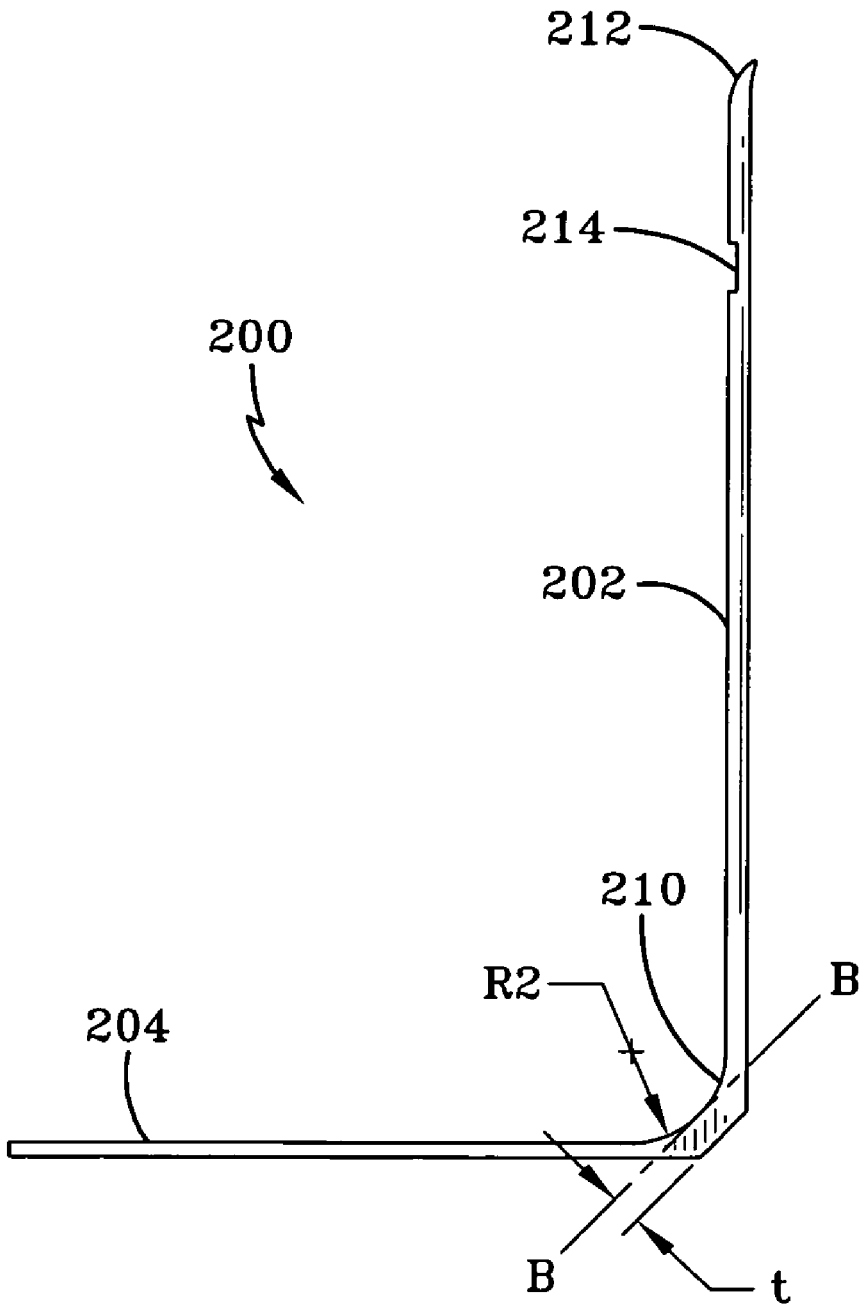
FIG. 4 is a side view or profile of the integral wall base and flash cove shown in FIG. 3.

A radius R2 of an inner surface 210 of concave cove 206 is much smaller than previous radius R1 of inner surface 110 as shown in FIG. 4. However, thickness t has remained the same. Subsequently, the length of an outer surface 208 of concave cove 206 has decreased. This results in an overall smaller concave cove 206. A tip 212 can also be provided on wall portion 202, along with a slot 214 for decorative and utility purposes as described above with respect to the embodiment shown in FIGS. 1 and 2. Since concave cove 206 is smaller, the amount of material needed to make integral wall base and flash cove 200 is less, thus reducing manufacturing and material costs. Furthermore, smaller concave cove 206 has other uses as well. For example, furniture can be placed closer to the wall to prevent things from falling off the back of the furniture such as blankets, pillows, books or lamps.

Figure 5:
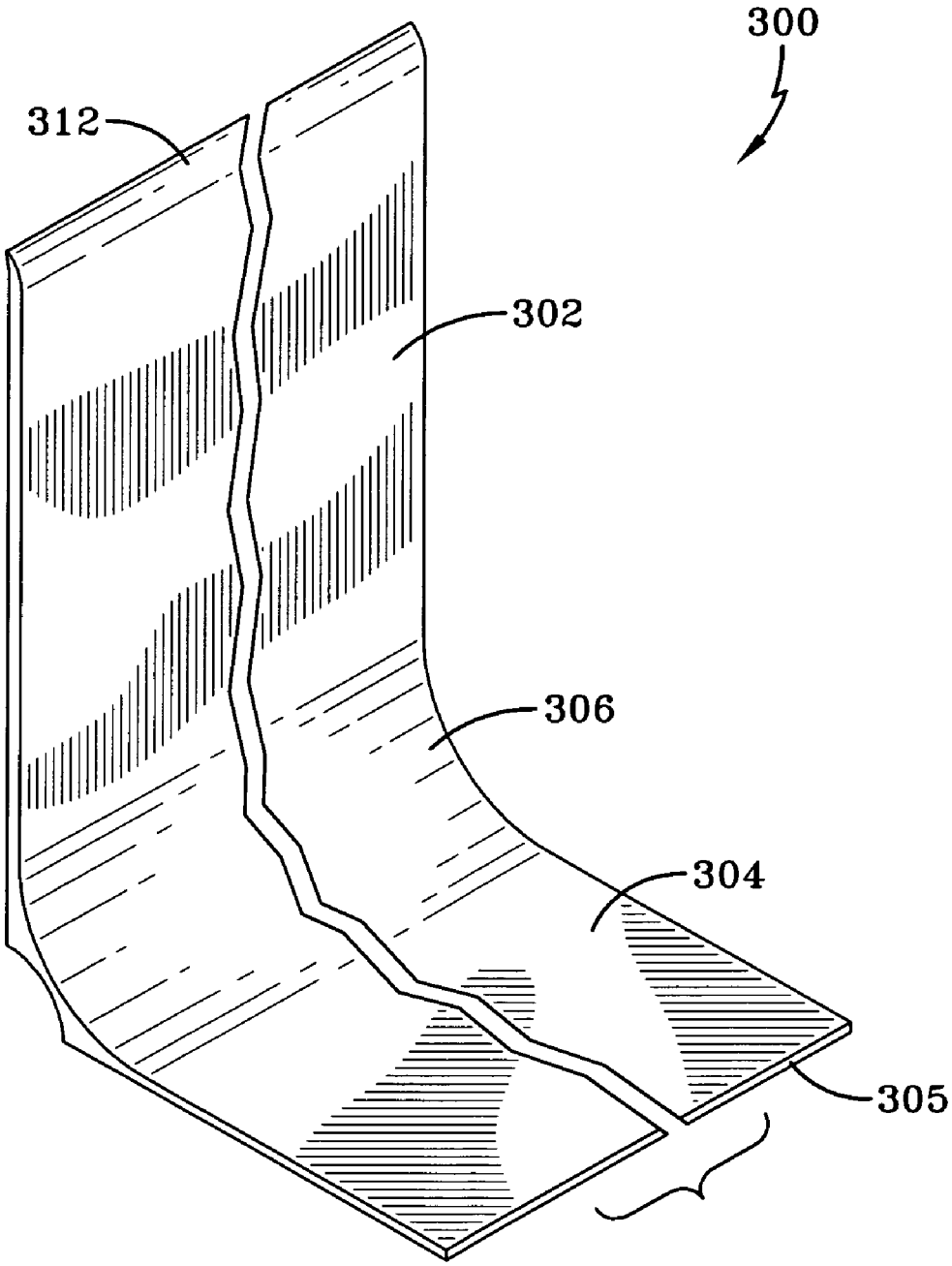
FIG. 5 is a perspective view of a third embodiment of the invention.

Turning now to FIG. 5, an integral wall base and flash cove 300 is shown as another embodiment. Integral wall base and flash cove 300 comprises a wall portion 302, an elongated toe or floor member 304 with a toe end 305 and a concave cove 306 which connects wall portion 302 to elongated toe 304. Wall portion 302 is substantially perpendicular to floor member 304. Wall portion 302 is installed to be parallel to the wall surface. Likewise, floor member 304 is parallel with the floor surface when installed. A tip 312 can also be provided on wall portion 302. Although not shown, wall portion 302 can also include a slot or any other relief or protrusion, or both for decorative purposes. It would be better if the slot were continuous so it could be made in a die as the plastic goes through the molding process.

Figure 6:
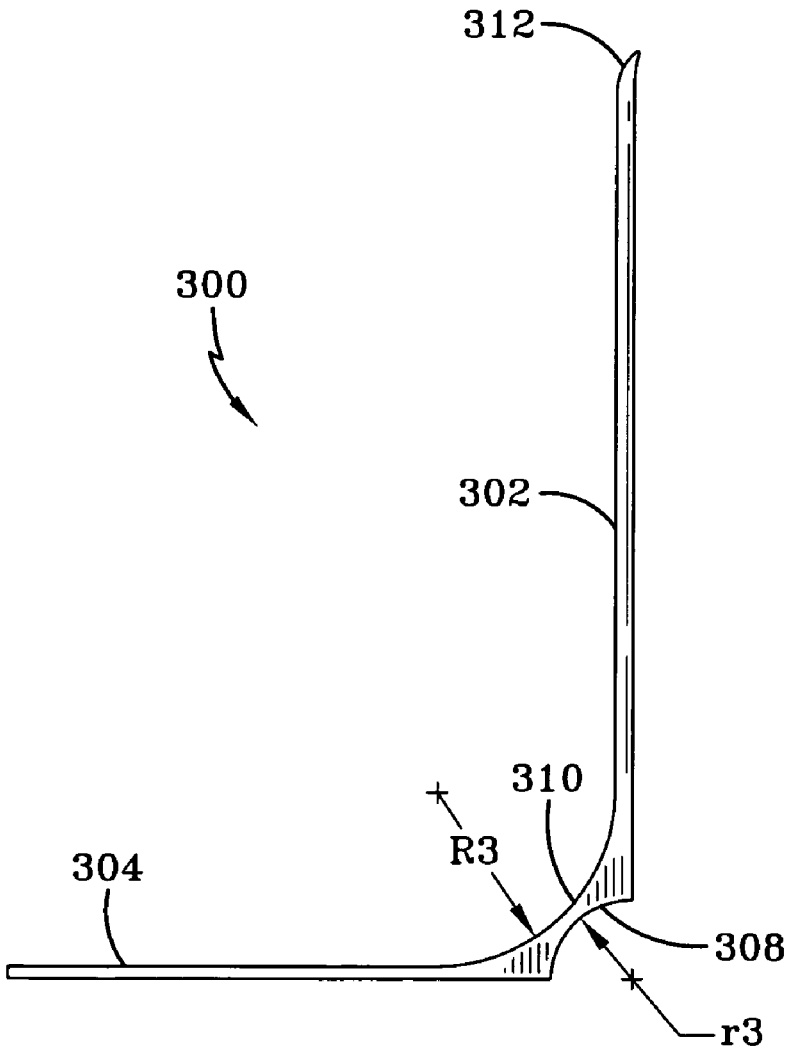
FIG. 6 is a side view or profile of the integral wall base and flash cove as shown in FIG. 5.

FIG. 6 is a side view of integral wall base and flash cove 300. Concave cove 306 comprises an outer surface 308 and an inner surface 310. Inner surface 310 is curved to provide a continuous smooth transition between wall portion 302 and elongated toe 304. Outer surface 308 is also curved.

Inner surface 310 is defined by a radius R3. Outer surface 308 is defined by a radius r3. Although FIGS. 5-6 show a single embodiment, any number of embodiments are possible where R3>r3, different radii, or no or plural radii can define respective inner and outer surfaces 308, 310. This would allow for at least a minimum thickness t defined as the distance between the parallel tangents of R and r.

There are advantages in selecting different lengths for radius r3. Radius r3 could cover an existing wooden mold, as where a room is being remodeled and the person remodeling does not want to go to the trouble and expense of removing the molding. In such case, radius r3 would be greater to allow for the previous molding to be masked by the present invention. Radius r3 could also be smaller to cover electrical wiring or a small pipe running along the corner of the wall and floor.

Figure 7:
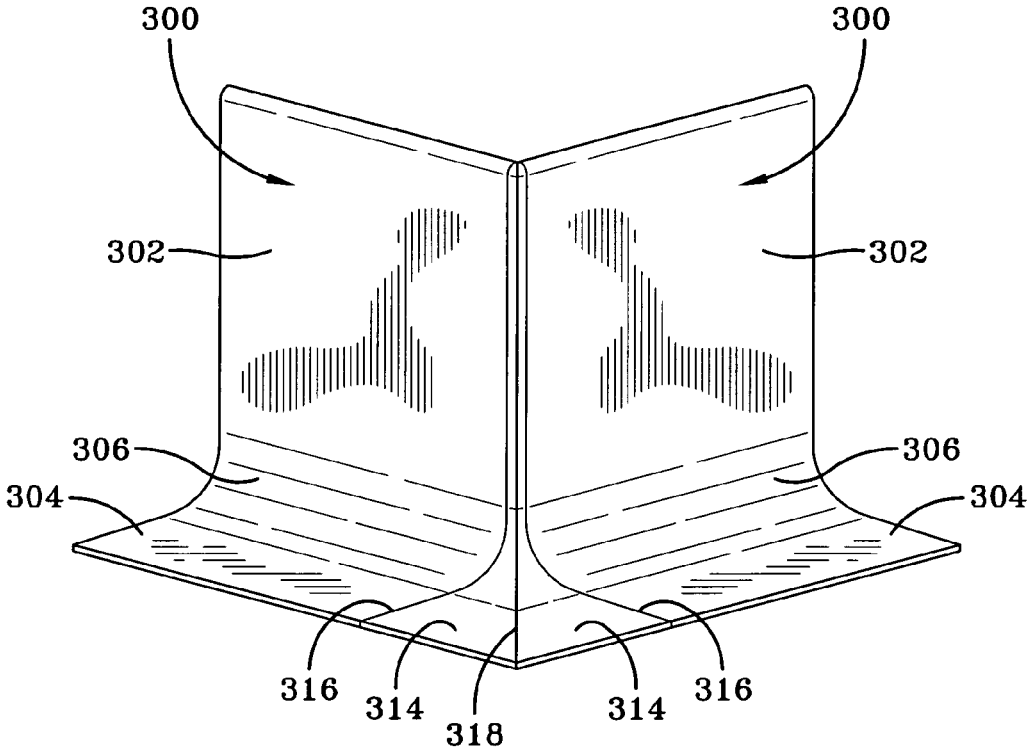
FIG. 7 is a perspective view of the integral wall base and flash cove as shown in FIG. 5 as applied to an outside corner of a wall.

FIG. 7 shows integral wall base and flash cove 300 as applied to an outside corner. After the upper portion of the integral wall base and flash cove 300 is wrapped around an outside corner wall like traditional wall base, a "truncated V-shaped" void defined by lines 316 and 318 is created in toe area (and not in the cove) as described above. Lines 316 and 318 extend through transverse portions of toe 314. Two "V-shaped" pieces 314 are cut to match lines 316 and 318, and inserted respectively into this void, and these seams at the two lines 316 and the center line 318 are sealed by chemical welding. Installation of the integral wall base and flash cove of the present invention will follow below.

Figure 8:
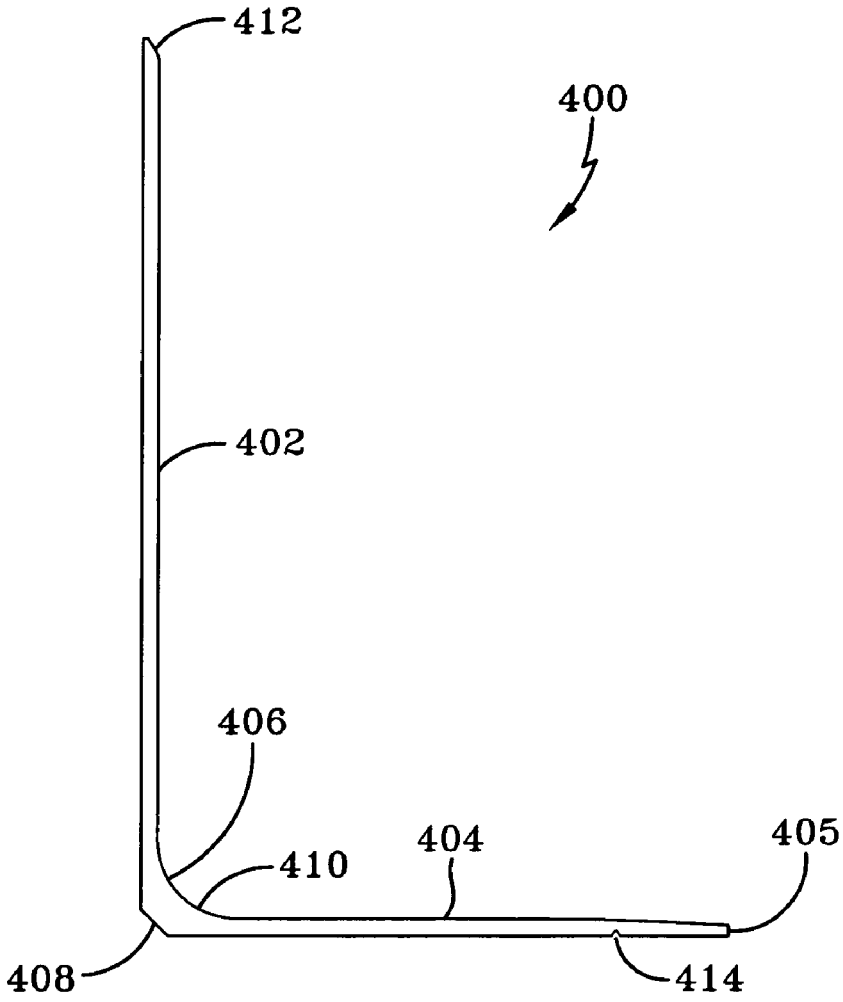
FIG. 8 is a side view or profile of yet another embodiment of the present invention.
Figure 8A:
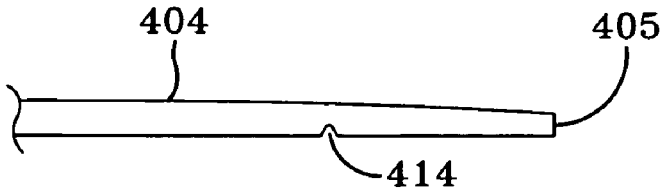
FIG. 8*a* is a magnified view of the toe portion of the embodiment as shown in FIG. 8.

FIG. 8 shows yet another embodiment of the present invention. FIG. 8 shows a side view of an integral wall base and flash cove 400. Integral wall base and flash cove 400 comprises a wall portion 402, an elongated toe or floor member 404 with a toe end 405 and a concave cove 406 which connects wall portion 402 to elongated toe 404. Wall portion 402 is substantially perpendicular to floor part 404. Wall portion 402 is installed to be parallel to the wall surface. Likewise, floor part 404 is parallel with the floor surface when installed. A tip 412 can also be provided on wall portion 402. Although not shown, wall portion 402 can also include a slot or any other relief or protrusion, or both for decorative or utility purposes (such as receiving an electrical line). It would be better if the slot were continuous so it could be made in a die as the plastic goes through the molding process. Concave cove 406 comprises an outer surface 408 and an inner surface 410. Inner surface 410 is curved to provide a continuous smooth transition between wall portion 402 and elongated toe 404. Outer surface 408 is planar and angled, but is preferably angled between about 30 degrees and 60 degrees relative to the floor.

Integral wall base and flash cove 400 also has a notch 414 on the under side of toe 404. Typically flooring is either 0.125 inches thick or 0.080 inches thick. When installing integral wall base and flash cove 400, toe 404 must be level with the edge of the flooring to create a smooth transition between the floor and wall base 400. Any height different would lead to a crevice where dirt, germs, bacteria, etc. could accumulate. Therefore, to accommodate a typical floor, toe 404 has a uniform thickness of 0.125 inches until near the end of toe 404. Toe 404 then tapers to a thickness of 0.080 from the upper part of toe 404 until the end of toe 404. Notch 414 gives the installer a marker line to make a uniform cut at notch 414 if the flooring is 01.25 inches thick. The end of toe 404 is then cut off so the 0.125 inch flooring abuts wall base 400 in a smooth transition. If the flooring is 0.080 inches thick, no cut is necessary.

The present invention can be manufactured and installed as a continuous integral wall base and flash cove. This allows for the integral wall base and flash cove to be cut with a miter saw, utility knife, or similar tool to make the outside and inside corners without the need of a separate molded corner piece. The continuous integral wall base and flash cove allows for fewer seams to be created when the unit is installed. Thus, fewer chemical or other welds would be necessary to create an integral wall base and flash cove for a clean room environment. Reducing the number of seams also reduces the number of potential flaws in any seal created, which otherwise could allow dirt, germs, bacteria, etc. to penetrate and remain.

As previously mentioned, the material for the integral wall base and flash cove can be a co-extruded polyvinyl chloride or thermoplastic rubber. Integral wall base and flash cove 100, 200, 300 and 400 can be extruded from a die having a profile with a wall portion transverse to a floor member. The seam sealer should be a suitable adhesive for creating a chemical weld for preventing any flaws or openings at the seams of the wall base. One such adhesive can be a solvent based adhesive such as styrene cement. A suitable adhesive can be used to adhere the integral wall base and flash cove to the floor and wall such as a latex acrylic adhesive or contact cement, although the type of adhesive used for the wall part and the floor part may be different.

There is also an enormous cost savings associated with the present invention. A relatively unskilled worker is paid around half as much as what a skilled floor laborer is paid. Furthermore, the hours for installation are greatly reduced. This combination could lead to a huge cost savings in a large building such as an office building, hotel, hospital, apartment building, dorms etc.

Elongated toe 104, 204, 304, 404 is also an important feature of the present invention. Elongated toe 104, 204, 304, 404 is preferably the same height as the flooring, so a smooth transition is created when the flooring (such as flooring tile) meets elongated toe 104, 204, 304, 404. The smooth transition between the two also allows for an easier seal to be formed between the two, by chemical or other welding. It is advantageous that elongated toe 104, 204, 304, 404 has a suitable length extending away from the wall. Typically, the length of elongated toe will be 4 inches, while the length of wall portion 102, 202, 302, 402 will be 6 inches. The length of elongated toe 104, 204, 304, 404 is measured from the rear side of wall portion 102, 202, 302, 402 (which contacts the wall) to the termination of elongated toe 104, 204, 304, 404. Similarly, the length of wall portion 102, 202, 302, 402 is measured from the bottom of elongated toe 104, 204, 304, 404 (which contacts the floor surface) to the termination of wall portion 102, 202, 302, 402. The 6 inch length of wall portion 102, 202, 302, 402 meets various building codes for bathrooms and healthcare facilities. Thus, the typical ratio of wall portion 102, 202, 302, 402 to elongated toe 104, 204, 304, 404 is 3:2. However, other lengths are possible. It is important that elongated toe 104, 204, 304, 404 has a sufficient length for an adult installer to hold a chemical weld gun steady and away from the wall and continuously move backwards to chemically weld a seam between elongated toe 104, 204, 304, 404 and the floor.

With the length of elongated toe 104, 204, 304, 404 being fairly long, say around 4 inches, it is not necessary for the flooring to meet so close to concave cove 106, 206, 306, 406 and possibly create a potential flaw in any seal between the two when installed, which would allow dirt, germs, bacteria, etc. to penetrate and remain. Also, elongated toe 104, 204, 304, 404 allows for ample space from the wall for an adult installer to sufficiently operate a chemical weld gun to chemically weld the seam between the floor and elongated toe 104, 204, 304, 404. When chemical welding, the adult installer must be on his or her knees and hold the chemical weld gun steady and use a continuous weld drop into the seam while moving backwards. Since the seam between the floor and elongated toe 104, 204, 304, 404 is located farther away from the wall, the adult installer's hands and knees have room to operate the chemical weld gun. This would not be the case if elongated toe 104, 204, 304, 404 is very small, say less than 3 inches or did not exist at all, which would cause the seam to be located nearer to the wall at a point where concave cove 106, 206, 306, 406 terminates at the floor.

Thus, elongated toe 104, 204, 304, 404 allows for easier installation of the wall base because a seal between the flooring and elongated toe 104, 204, 304, 404 can occur farther away from concave cove 106, 206, 306, 406, providing an easier fit and eliminating the aforesaid problems. Elongated toe 104, 204, 304, 404 also makes a greater curve possible, which is easier to clean than a sharp curve.

Concave coves 106, 206, 306, 406 allow for an overall design of integral wall base and flash coves 100, 200, 300, 400 which are more flexible during installation. Typically, the floor and wall do not meet at exactly 90 degrees. Rather, this angle usually varies from about 85 to about 95 degrees. However, the integral wall base and flash cove is typically extruded at 90 degrees, i.e. the angle between elongated toe 104, 204, 304, 404 and wall portion 102, 202, 302, 402 respectively. Thus, for the integral wall base and flash cove to fit securely against the wall and the floor where the angle formed between them is not exactly 90 degrees, slight bending of the integral wall base and flash cove is necessary, either outwardly or inwardly. The flexibility of the integral wall base and flash cove does not affect the integrity of the overall structure of the unit, and will not result in failure or cracking. Therefore, integral wall base and flash cove 100, 200, 300, 400 can accommodate angles between the floor and the wall other than 90 degrees.

The installation of the integral wall base and flash cove will now be described as shown in FIGS. 9-14 with respect to the embodiment of FIG. 8. However, the installation described below applies to all of the embodiments of the present invention. The following tools are needed to install the integral wall base and flash cove:

Suitable adhesive (as discussed below)
⅛" square-notched trowel
Utility knife
Straight edge
Tape measure
Carpenter's square
Hand roller
Dividers (Crain #380 or equivalent)
Top-Set or Pull-Type Gouging Tool The installer should first ensure that all floors and walls are clean, dry, free of dust, all paints, wallpaper, and all other foreign matter, which may affect adhesive bonding of the integral wall base and flash cove 400.

Since the integral wall base and flash cove 400 will be coiled for shipping, the installer should allow the coiled integral wall base and flash cove 400 to lay flat for at least 24 hours at 70° F. prior to installation.

The integral wall base and flash cove 400 is then dry fit without adhesive to the room by starting at an inside corner of the room and then proceeding to an outside corner. The outside corner position on the back of the vertical portion of the integral wall base and flash cove 400 is marked with a pencil, scribe, or similar marking device where the bend will occur at the outside corner edge.

The integral wall base and flash cove 400 is then laid face down and flat on the floor. Using a topset or pull-type gouging tool, a shallow notch 501 is made along the pencil line on the vertical section of the integral wall base and flash cove 400. The notch depth should not exceed one-quarter the total thickness of the integral wall base and flash cove 400. Following along the same pencil line, a cut is completely made through the toe 404 using a utility knife. The cove portion 406 is not cut and no shallow notch is made.

Figure 9:
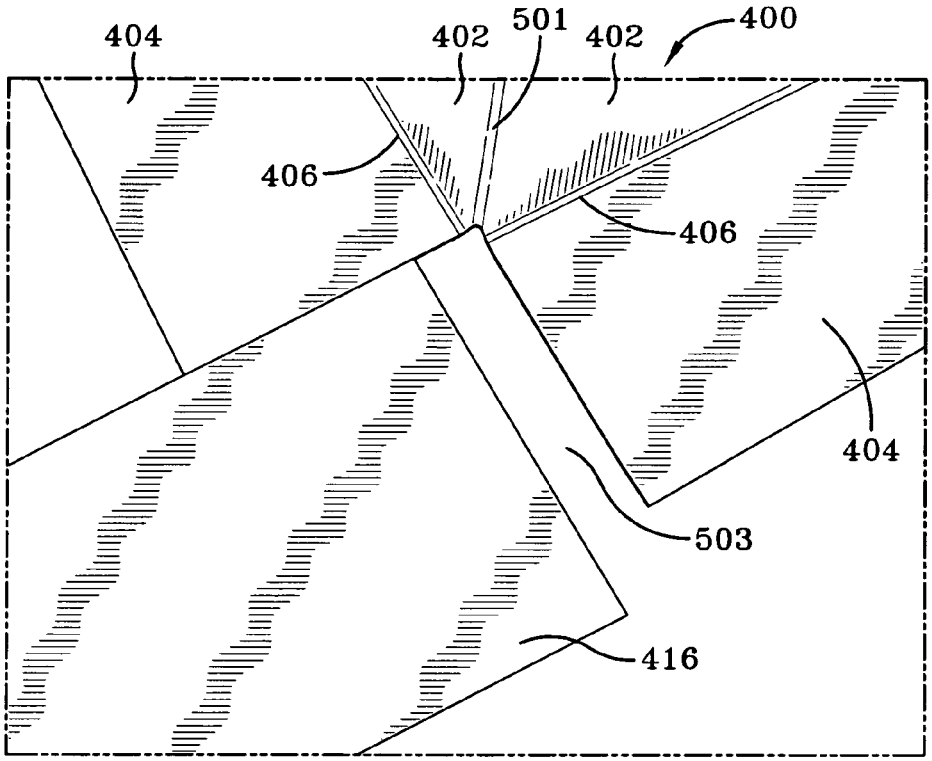
FIG. 9 is a perspective view of the integral wall base and flash cove of FIG. 8 as applied to an outside corner with a floor piece being inserted.
Figure 10:
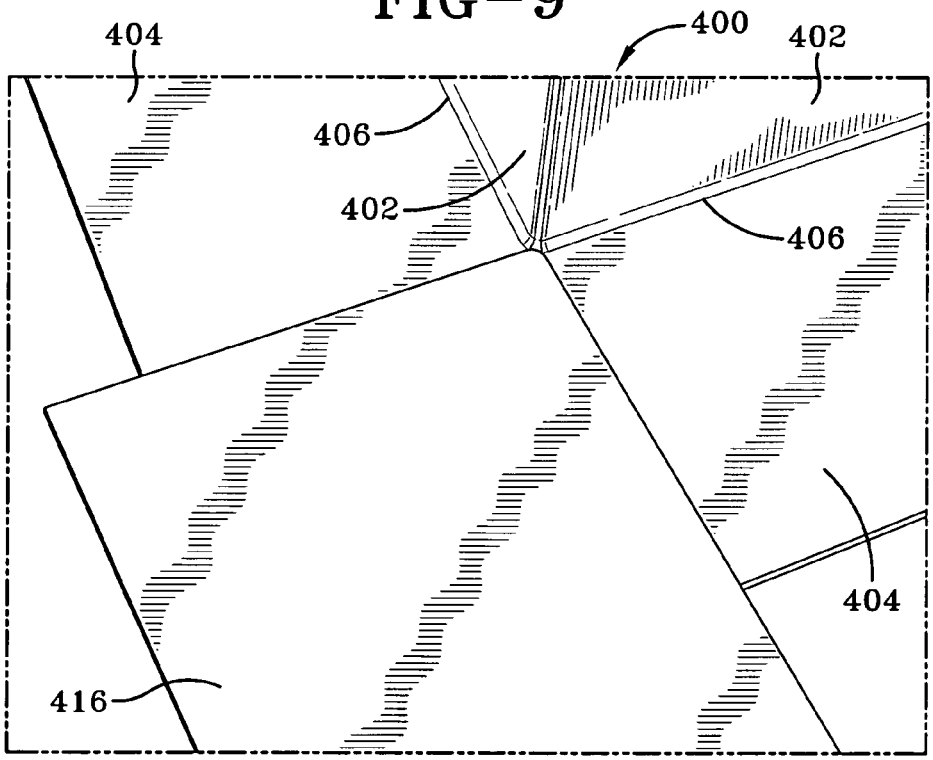
FIG. 10 is a perspective view of the integral wall base and flash cove of FIG. 8 with the floor piece fully inserted.

The integral wall base and flash cove 400 is then positioned back on the wall and wrapped around the outside corner as shown in FIG. 9 as shown by wall portion 402. The shallow notch 501 allows the vertical wall to be wrapped around the outside corner. The outside corner is flush with the shallow notch 501 when installed. The vertical portion of the integral wall base and flash cove 400 is wrapped around the outside corner similar to a traditional wall base but the cut in the toe 404 will open up leaving a square or rectangular opening or key 503 at the base of the corner as seen in FIGS. 9 and 10.

Figure 13:
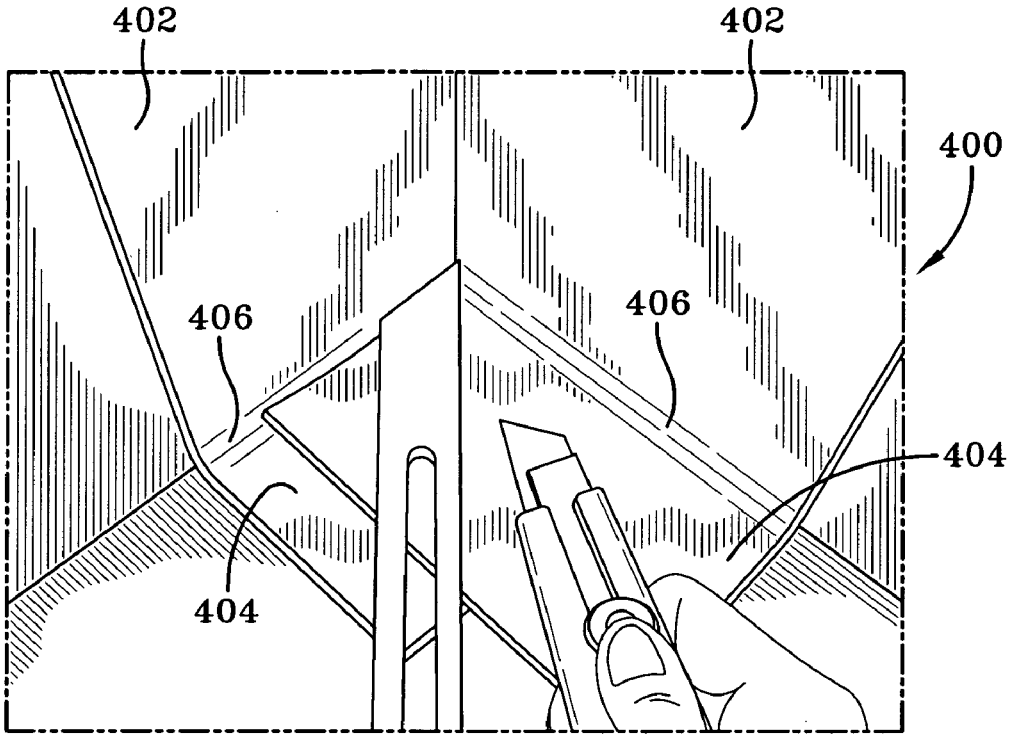
FIG. 13 is a perspective view of the integral wall base and flash cove of FIG. 9 after the inside corner has been butted or scribed, showing use of a utility knife to cut the overlapping toe pieces.

The integral wall base and flash cove can be wrapped around inside corners of a wall as well. The integral wall base and flash cove is continued to be dry fit to the next inside corner. To apply the integral wall base and flash cove to an inside corner, a groove may be cut into the back of wall portion 102, 202, 302, 402 of the integral wall base and flash cove to create a hinge effect. A cut must be made in the toe portion 104, 204, 304, 404 to separate the respective toe portions when wrapped around the inside corner. The toe section of the wall base and flash cove will be overlapped as shown in FIG. 13. The toe portion is then double cut at a 45° angle relative to the internal wall angle using a utility knife and a straight edge as seen in FIG. 13. Similar to the outside corner, only a cut must be made in the toe of the integral wall base and flash cove.

Figure 11:
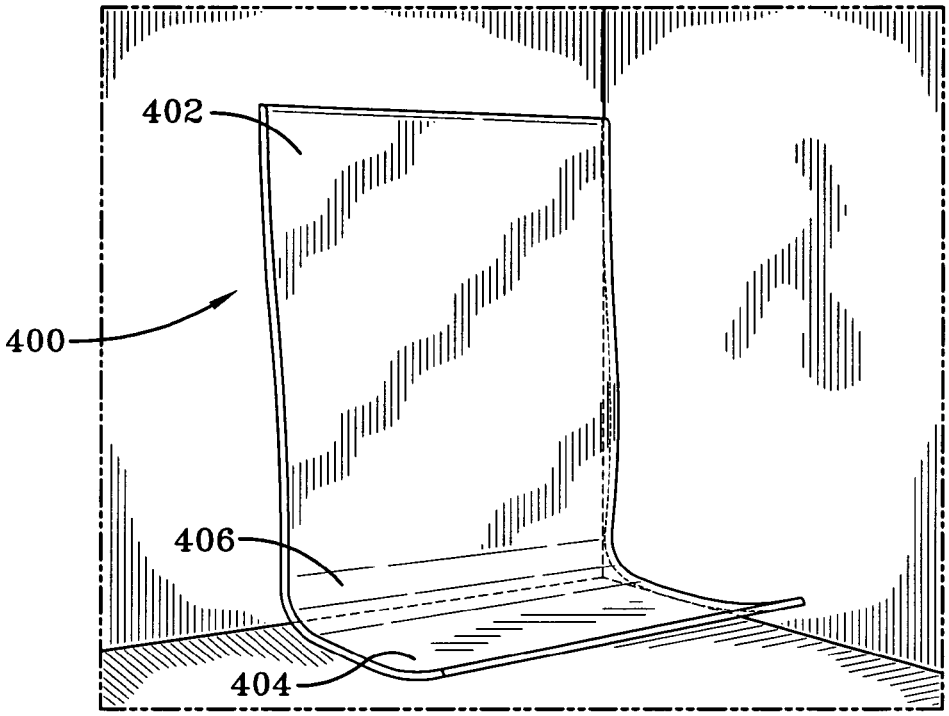
FIG. 11 is a perspective view of the integral wall base and flash cove of FIG. 8 being installed by butting the corner.
Figure 12:
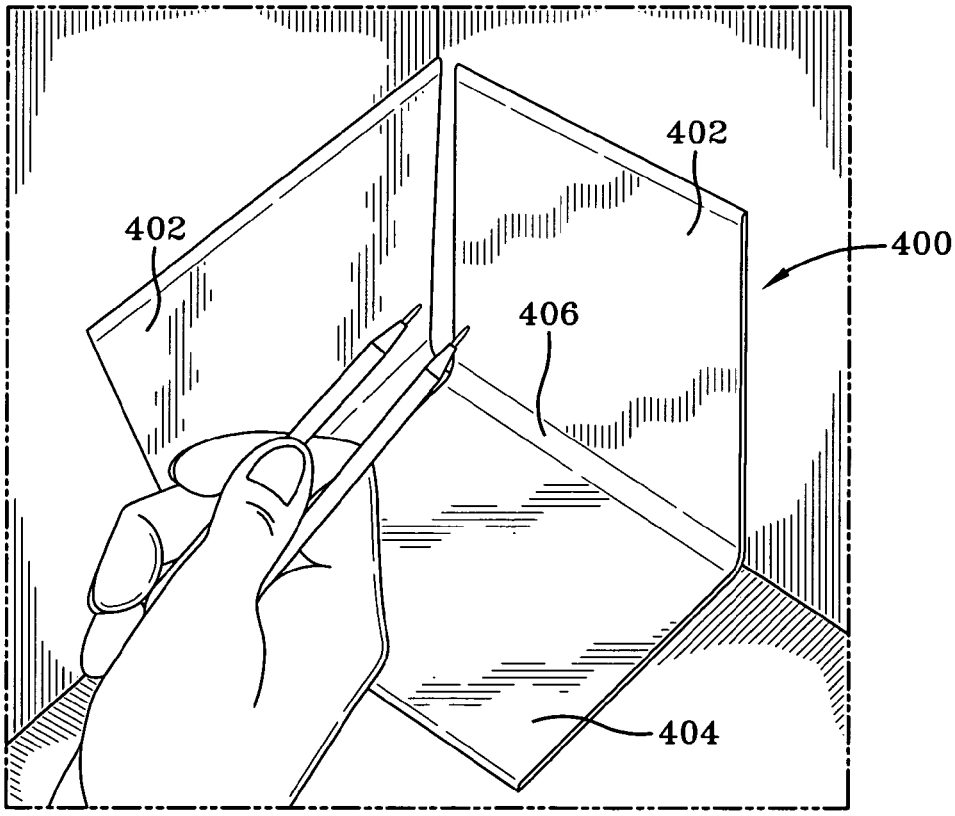
FIG. 12 is a perspective view of the integral wall base and flash cove of FIG. 9 being installed by scribing the corner using a set of dividers.
Figure 14:
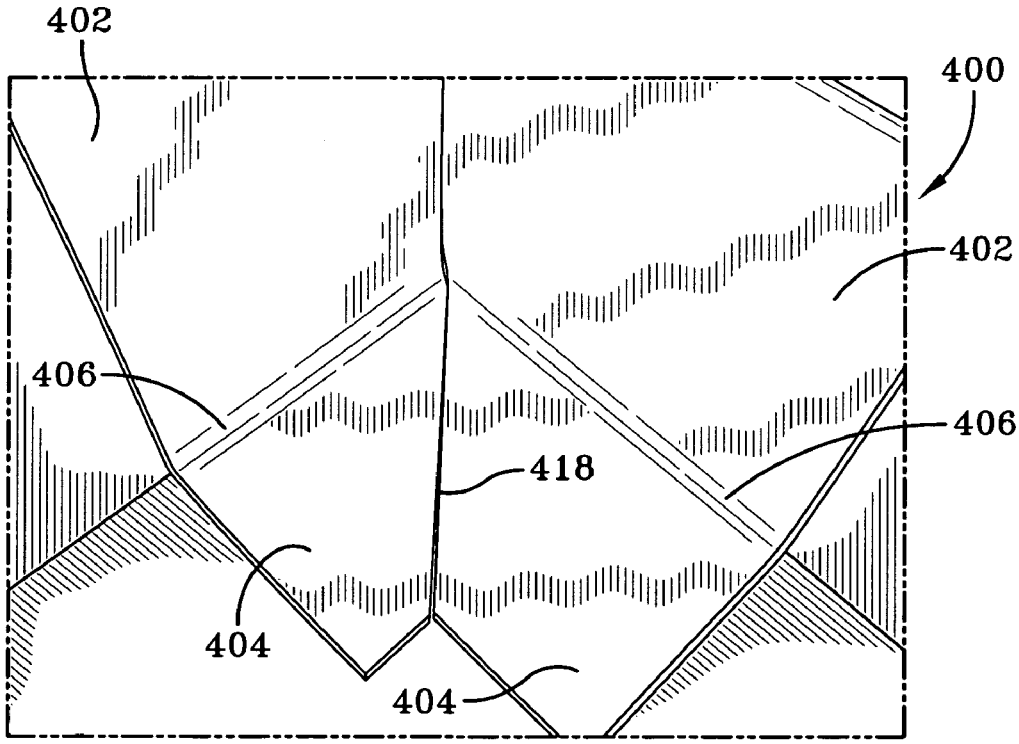
FIG. 14 is a perspective view of the integral wall base and flash cove of FIG. 13 after the overlapping toe pieces have been cut.

The inside corners can also be butted or scribed as opposed to wrapped around the inside corner. If the inside corner is plumb, the integral wall base and flash cove can be butted as shown in FIG. 11. If the inside corner is not plumb, then the integral wall base and flash cove is scribed into the inside corner using a set of dividers as shown in FIG. 12. After the vertical wall portion 402 has been fit tight the toe 404 is then double cut to complete the corner as seen in FIG. 13. FIG. 14 shows the integral wall base and flash cove 400 after the double cut, with the newly cut edges of toe 404 abutted at juncture 418.

After the section of integral wall base and flash cove has been properly dry fitted, the integral wall base and flash cove is laid face down and flat on the floor. An appropriate adhesive as discussed below is then applied to the entire back surface of the wall base. The back surface of the wall base may be ribbed. The adhesive is spread the across the rear portion of the integral wall base and flash cove except for approximately a ¼" (6.35 mm) uncovered space at the top of the integral wall base and flash cove to prevent the adhesive from oozing onto the wall above the integral wall base and flash when installed.

The type of adhesive used for the integral wall base and flash cove depends on whether the surface is porous or nonporous. A porous surface, i.e. drywall, will absorb moisture. A nonporous surface, i.e. painted concrete block, will not absorb moisture. It has been found that for a porous wall surface installation, an acrylic adhesive should be applied to the back of the integral wall base and flash cove with a ⅛" square notch trowel. An acceptable acrylic adhesive has been found to be Johnsonite Inc. #960 Acrylic Wall Base Adhesive. The installer should allow the adhesive to flash off for 10 to 15 minutes before installing the integral wall base and flash cove.

For a non-porous wall surface installation, an acrylic flooring and tread adhesive should be applied to the back of the integral wall base and flash cove with a 1/16" V-notch trowel. An acceptable adhesive has been found to be Johnsonite Inc. #965 Acrylic Flooring and Tread Adhesive. The adhesive should be allowed to dry to the touch with little or no transfer of the adhesive to the finger. Once the adhesive reaches the "dry-to-touch" state, the integral wall base and flash cove should be installed within 45 minutes and immediately rolled.

To roll the integral wall base and flash cove, the integral wall base and flash cove is positioned on the wall and floor surface and rolled with a hand roller. The installer should always roll back to the starting point to prevent stretching the wall base.

After integral wall base and flash cove 400 has been installed on the wall, a key section 416 is cut from a vertical portion of the wall base profile large enough to fill the void or key 503 at the base of the outside corner. The key section 416 is then scribed, cut, and dry fit to fill the key as shown in FIGS. 9 and 10. Adhesive is then applied to the back of key section 416 and installed. Key section 416 is then rolled with a hand roller to ensure proper bond of the adhesive. This installation procedure is repeated for all of the outside and inside corners until integral wall base and flash cove 400 installation is complete.

If required for a sanitary application as described above, the integral wall base and flash cove can be chemically welded after the resilient flooring material has been installed. If this is the case, the integral wall base is welded to itself and the resilient flooring at each seam created between the integral wall base and flash cove and/or the resilient flooring. For example, key section 416 is welded at the seams created between toe 404 and key section 416. However, since only key section 416 has been inserted in the toe area of the continuous integral wall base and flash cove, only these seams need to be welded. Because the upper portion of the integral wall base and flash cove 400 (i.e. wall portion 402 and concave cove 406) is continuously wrapped around the outside corner, the need for a separate molded corner piece is eliminated and there are no seams to weld on this upper portion of the integral wall base and flash cove. Therefore, there is no need to cut an outside corner at a 45° angle with a miter saw.

Similar to the outside corner, the seams at the inside corner are welded as well. Thus, the overall number of seams to weld is reduced, which in turn reduces the number of potential flaws in the integral wall base and flash cove for a sanitary application. To complete the installation, key section 416 is welded at the seams created between key section 416 and the resilient flooring, and then finally at the remaining seams between elongated toe 404 and the resilient flooring.

Chemical welding can be performed with a PVC Welding Fluid or Gel. Caution must be exercised when using welding fluid and gels since these products are highly flammable.

Any remaining wet adhesive can be removed with a water dampened cloth. If the adhesive has dried, a cloth dampened with mineral spirits will remove any excess dried adhesive.

The integral wall base and flash cove of the present invention allows for various flexible design profiles that are currently not available with separate molded corner pieces. Profile designs are most practical for extrusion capabilities. A continuous extruded profile, allows for flexible designs that can be of varying thickness, height, depth and aesthetic characteristics. On the vertical portion of the profile which is to be applied to the wall, many design variations are possible. The only limitation in these designs is the requirement that the profile can be wrapped around the outside corner without cutting or mitering the profile. Various ribs, ridges, grooves and surface textures are possible to enhance the decorative appearance of the base without compromising the installation methods described above.

Although the invention has been described with regard to certain preferred example embodiments, it is to be understood that the present disclosure has been made by way of example only, and the improvements, changes and modifications in the details of construction and the combination and arrangement of parts may be resorted to without departing from the spirit and scope of the invention. Such improvements, changes and modifications within the skill of the art are intended to be covered by the scope of the present disclosure.

We claim:

1. An integral wall base and flash cove having a continuous extruded profile, said integral wall base and flash cove to be installed where a floor meets a wall in a room, said integral wall base and flash cove comprising:

a wall portion for attachment to the wall, said wall portion having a thickness, an inner surface and a length;

an elongated toe for attachment to a floor base or a floor substrate, said elongated toe having a thickness, an inner surface, a length, a toe end and a floor area, said floor area being parallel to the floor when said integral wall base and flash cove is installed; and a concave cove having a thickness and operatively connecting said wall portion to said elongated toe, said concave cove having a stronger transverse strength than said wall portion and said elongated toe;

said integral wall base and flash cove being flexible and continuously wrapable around at least one outside corner or at least one inside corner as a unitary construction if the room has at least one outside corner or at least one inside corner.

2. An integral wall base and flash cove according to claim 1, said concave cove comprising:

a planar angled outer surface facing said floor and said wall when said integral wall base and flash cove is installed; and a concave inner surface facing the room when said integral wall base and flash cove is installed, said concave inner surface providing a smooth transition between said wall portion and said elongated toe.

3. An integral wall base and flash cove according to claim 1, said concave cove comprising:

a convex outer surface facing said floor and said wall when said integral wall base and flash cove is installed;

a concave inner surface facing the room when said integral wall base and flash cove is installed, said concave inner surface providing a smooth transition between the inner surface of said wall portion and the inner surface of said elongated toe.

4. An integral wall base and flash cove according to claim 1, wherein said integral wall base and flash cove is devoid of a cap strip and a cove stick.

5. An integral wall base and flash cove according to claim 1, said integral wall base and flash cove comprising:

a notch on the underside of said elongated toe for locating and establishing a uniform cut during installation of said integral wall base and flash cove.

6. An integral wall base and flash cove according to claim 1, wherein said elongated toe tapers in thickness from said concave cove to said toe end.

7. An integral wall base and flash cove according to claim 5, wherein said elongated toe tapers in thickness from said notch to said elongated toe end.

8. An integral wall base and flash cove according to claim 6, wherein said elongated toe tapers from 0.125 inches to 0.080 inches.

9. An integral wall base and flash cove according to claim 1, wherein the thickness of said concave cove is greater than the thickness of said wall portion.

10. An integral wall base and flash cove according to claim 1, wherein the thickness of said concave cove is greater than the thickness of said elongated toe.

11. An integral wall base and flash cove according to claim 1 wherein a ratio of the length of said wall portion to the length of said elongated toe is 3:2.

12. An integral wall base and flash cove according to claim 1 wherein the length of said elongated toe is 4 inches.

13. An integral wall base and flash cove according to claim 1, said integral wall base and flash cove being devoid of a separate outside corner piece or a separate inside corner piece.

14. An integral wall base and flash cove according to claim 1 wherein said elongated toe is sufficient in length from said concave cove to enable an adult installer to move along said elongated toe on the installer's knees and hold a chemical weld gun steady and use a continuous weld drop into a seam while the installer is moving backwards.

15. An integral wall base and flash cove according to claim 1 wherein said wall portion being continuously wrapable around at least one outside corner or at least one inside corner as a unitary construction.

16. An integral wall base and flash cove according to claim 1 wherein said wall portion and said concave cove being continuously wrapable around at least one outside corner or at least one inside corner is a unitary construction.

17. An integral wall base and flash cove according to claim 1 wherein said wall portion being continuously wrapable around at least one outside corner or at least one inside corner is seamless.

18. An integral wall base and flash cove according to claim 1 wherein said wall portion and said concave cove being continuously wrapable around at least one outside corner or at least one inside corner is seamless.

19. An integral wall base and flash cove having a continuous extruded profile, said integral wall base and flash cove to be installed where a floor meets a wall in a room, said integral wall base and flash cove comprising:

a wall portion for attachment to the wall, said wall portion having a thickness, an inner surface and a length;

an elongated toe for attachment to a floor base or a floor substrate, said elongated toe having a thickness, a length, a toe end and a floor area, said floor area being parallel to the floor when said integral wall base and flash cove is installed; and a concave cove operatively connecting said wall portion to said elongated toe and said concave cove having a stronger transverse strength than said wall portion and said elongated toe;

wherein said floor area of said elongated toe is dimensioned to allow sufficient adhesive coverage and bonding to the floor base or the floor substrate to reduce a risk of displacement of said integral wall base and flash cove or seal failure of an adhesive for the adhesive coverage upon impact to said integral wall base and flash cove.

20. An integral wall base and flash cove according to claim 19, said concave cove further comprising:

a planar angled outer surface facing said floor and said wall when said integral wall base and flash cove is installed; and a concave inner surface facing the room when said integral wall base and flash cove is installed, said concave inner surface providing a smooth transition between said wall portion and said elongated toe.

21. An integral wall base and flash cove according to claim 19, wherein said integral wall base and flash cove is devoid of a cap strip and a cove stick.

22. An integral wall base and flash cove according to claim 19, said integral wall base and flash cove further comprising:

a notch on the underside of said elongated toe for locating and establishing a uniform cut during installation of said integral wall base and flash cove.

23. An integral wall base and flash cove according to claim 19, wherein said elongated toe tapers in thickness from said concave cove to said toe end.

24. An integral wall base and flash cove according to claim 22, wherein said elongated toe tapers in thickness from said notch to said elongated toe end.

25. An integral wall base and flash cove according to claim 23, wherein said elongated toe tapers from 0.125 inches to 0.080 inches.

26. An integral wall base and flash cove according to claim 19, wherein the thickness of said concave cove is greater than the thickness of said wall portion.

27. An integral wall base and flash cove according to claim 19, wherein the thickness of said concave cove is greater than the thickness of said elongated toe.

28. An integral wall base and flash cove according to claim 19 wherein a ratio of the length of said wall portion to the length of said elongated toe is 3:2.

29. An integral wall base and flash cove according to claim 19 wherein the length of said elongated toe is 4 inches.

30. An integral wall base and flash cove according to claim 19, said integral wall base and flash cove being devoid of a separate outside corner piece or a separate inside corner piece.

31. An integral wall base and flash cove according to claim 19 wherein said elongated toe is sufficient in length from said concave cove to enable an adult installer to move along said elongated toe on the installer's knees and hold a chemical weld gun steady and use a continuous weld drop into a seam while the installer is moving backwards.

32. An integral wall base and flash cove having a continuous extruded profile, said integral wall base and flash cove to be installed where a floor meets a wall in a room, said integral wall base and flash cove comprising:

a wall portion for attachment to the wall, said wall portion having a length and a wall thickness;

an elongated toe for attachment to a floor base or a floor substrate, said elongated toe having a thickness, a length and a toe end; and a concave cove having a predetermined fixed cove thickness and an inner surface, said inner surface having an inner cove radius, said concave cove operatively connecting said wall portion to said elongated toe and said concave cove having a stronger transverse strength than said wall portion and said elongated toe;

said inner cove radius being variable while maintaining the predetermined fixed cove thickness;

wherein the predetermined fixed cove thickness is greater than the wall thickness.

33. An integral wall base and flash cove according to claim 32, said concave cove further comprising:

a planar angled outer surface facing the floor base or the floor substrate and the wall when said integral wall base and flash cove is installed.

34. An integral wall base and flash cove according to claim 32, wherein said integral wall base and flash cove is devoid of a cap strip and a cove stick.

35. An integral wall base and flash cove according to claim 32, said integral wall base and flash cove further comprising:

a notch on the underside of said elongated toe for locating and establishing a uniform cut during installation of said integral wall base and flash cove.

36. An integral wall base and flash cove according to claim 32, wherein said elongated toe tapers in thickness from said concave cove to said toe end.

37. An integral wall base and flash cove according to claim 35, wherein said elongated toe tapers in thickness from said notch to said elongated toe end.

38. An integral wall base and flash cove according to claim 36, wherein said elongated toe tapers from 0.125 inches to 0.080 inches.

39. An integral wall base and flash cove according to claim 32, wherein the predetermined fixed cove thickness is greater than the thickness of said elongated toe.

40. An integral wall base and flash cove according to claim 32 wherein a ratio of the length of said wall portion to the length of said elongated toe is 3:2.

41. An integral wall base and flash cove according to claim 32 wherein the length of said elongated toe is 4 inches.

42. An integral wall base and flash cove according to claim 32, said integral wall base and flash cove being devoid of a separate outside corner piece or a separate inside corner piece.

43. An integral wall base and flash cove according to claim 32 wherein said elongated toe is sufficient in length from said concave cove to enable an adult installer to move along said elongated toe on the installer's knees and hold a chemical weld gun steady and use a continuous weld drop into a seam while the installer is moving backwards.

44. An integral wall base and flash cove according to claim 32, said elongated toe further comprising a floor area, wherein said floor area of said elongated toe is dimensioned to allow sufficient adhesive coverage and bonding to the floor base or the floor substrate to reduce a risk of displacement of said integral wall base and flash cove or seal failure of an adhesive for the adhesive coverage upon impact to said integral wall base and flash cove.

45. An integral wall base and flash cove having a continuous extruded profile, said integral wall base and flash cove to be installed where a floor meets a wall in a room, said integral wall base and flash cove comprising:

a wall portion for attachment to the wall, said wall portion having an inner surface, a length and a wall thickness;

an elongated toe for attachment to the floor, said elongated toe having an inner surface, a thickness, a length and a toe end; and a concave cove comprising:

an outer surface having an outer radius facing said floor and said wall when said integral wall base and flash cove is installed; and an inner surface having an inner radius facing the room when said integral wall base and flash cove is installed, said inner surface providing a smooth transition between the inner surface of said wall portion and the inner surface of said elongated toe;

said concave cove having a minimum thickness along the distance between parallel tangents of said inner radius and said outer radius;

wherein said inner radius is greater than said outer radius to maintain said minimum thickness.

46. An integral wall base and flash cove according to claim 45, wherein said integral wall base and flash cove is devoid of a cap strip and a cove stick.

47. An integral wall base and flash cove according to claim 45, said integral wall base and flash cove further comprising: a notch on the underside of said elongated toe for locating and establishing a uniform cut during installation of said integral wall base and flash cove.

48. An integral wall base and flash cove according to claim 45, wherein said elongated toe tapers in thickness from said concave cove to said toe end.

49. An integral wall base and flash cove according to claim 47, wherein said elongated toe tapers in thickness from said notch to said elongated toe end.

50. An integral wall base and flash cove according to claim 48, wherein said elongated toe tapers from 0.125 inches to 0.080 inches.

51. An integral wall base and flash cove according to claim 45, wherein the minimum thickness of said concave cove is greater than the wall thickness of said wall portion.

52. An integral wall base and flash cove according to claim 45, wherein the minimum thickness of said concave cove is greater than the thickness of said elongated toe.

53. An integral wall base and flash cove according to claim 45 wherein a ratio of the length of said wall portion to the length of said elongated toe is 3:2.

54. An integral wall base and flash cove according to claim 45 wherein the length of said elongated toe is 4 inches.

55. An integral wall base and flash cove according to claim 45, said integral wall base and flash cove being devoid of a separate outside corner piece or a separate inside corner piece.

56. An integral wall base and flash cove according to claim 45 wherein said elongated toe is sufficient in length from said concave cove to enable an adult installer to move along said elongated toe on the installer's knees and hold a chemical weld gun steady and use a continuous weld drop into a seam while the installer is moving backwards.

57. An integral wall base and flash cove according to claim 45, said elongated toe further comprising a floor area, wherein said floor area of said elongated toe is dimensioned to allow sufficient adhesive coverage and bonding to the floor base or the floor substrate to reduce a risk of displacement of said integral wall base and flash cove or seal failure of an adhesive for the adhesive coverage upon impact to said integral wall base and flash cove.

* * * * *